US005101587A

United States Patent [19]

Toraby-Payhan

[11] Patent Number: 5,101,587

[45] Date of Patent: Apr. 7, 1992

[54] NUMERAL DISPLAY DEVICE

[76] Inventor: Reza Toraby-Payhan, 1889 N. 105th E. Ave., Tulsa, Okla. 74116

[21] Appl. No.: 537,694

[22] Filed: Jun. 14, 1990

[51] Int. Cl.[5] ..... G09F 11/00

[52] U.S. Cl. ..... 40/450; 40/446; 40/449; 40/470; 40/471

[58] Field of Search ..... 40/446, 447, 449, 450

[56] References Cited

U.S. PATENT DOCUMENTS 3,537,197 11/1970 Smith ..... 40/449
3,789,525 2/1974 Bugg ..... 40/450
4,024,532 5/1977 Sherwin ..... 40/450
4,507,888 4/1985 Robinson et al. ..... 40/449

*Primary Examiner*—Kenneth J. Dorner
*Assistant Examiner*—Milton Nelson, Jr.
*Attorney, Agent, or Firm*—Head & Johnson

[57] ABSTRACT

A numeral display device having at least one visible face. Each segment of the device has a transparent outer pane and a spaced, parallel inner pane forming a pocket, a first portion of the pocket being aligned with and visible through an opening in the face. A flexible film is received in each pocket. A mechanism is provided to insert and withdraw each film from the first portion of each pocket so that each segment will either contrast with or match the face.

9 Claims, 11 Drawing Sheets 55
53
53
40
24
3
26
22
40
12

60
62
58
62
62
7
63
76
12'

NUMERAL DISPLAY DEVICE

BACKGROUND OF THE INVENTION

1. Field of the Invention

The present invention relates to a numeral display device wherein individual segments arranged to comprise each numeral may be selectively lightened, darkened, or changed in color from the surrounding background in order to make the desired numeral visible. In particular, the present invention relates to a numeral display device having self-storing segments.

2. Prior Art

The system of seven segment numerals has heretofore been widely used, both with manually changeable segments and with liquid crystal displays. The individual segments are lightened or darkened depending on the desired numeral to be formed from 0 to 9. Liquid crystal displays have been found to be adequate for small devices viewed at short distances but are difficult to see in large devices viewed at longer distances.

The present invention is not constrained to small displays and may readily be adapted to large highway signs. Additionally, the present invention provides a display device that may be remotely controlled.

Applicant has conducted a patent search and is aware of the following U.S. patents:

| U.S. PAT. NO. | PATENTEE | ISSUE DATE |
|---|---|---|
| 2,439,553 | Winn | April 13, 1948 |
| 3,200,525 | Francis | August 17, 1965 |
| 3,582,907 | Taylor | June 1, 1971 |
| 3,521,946 | Wrench | July 28, 1970 |
| 2,986,982 | Kaprelian | June 6, 1961 |
| 2,433,456 | Jansen | December 3, 1947 |
| 2,489,751 | Chandler | November 29, 1949 |
| 4,796,370 | Chang | January 10, 1989 |
| 4,164,824 | Nidelkoff | August 21, 1979 |
| 3,273,270 | Skrobish | Sept. 20, 1966 |
| 4,777,747 | Murray, Jr | October 18, 1988 |
| 4,627,182 | Weiss | December 9, 1986 |
| 4,539,768 | Halliday | Sept. 10, 1985 |
| 3,764,200 | Glattli | October 9, 1973 |
| 3,814,506 | Steele | June 4, 1974 |
| 3,789,525 | Bogg | February 5, 1974 |
| 4,220,948 | Trame | September 2, 1980 |
| 4,024,532 | Sherwin | May 17, 1977 |

Kaprelian (U.S. Pat. No. 2,986,982) discloses a pair of spaced glass plates. A center opening is connected by a tube to a pump in order to move opaque fluid from a tank. In the normal pumping condition, light cannot pass through the fluid. To open, the pump sends air through the tube which fills the space and allows light to pass therethrough.

Sherwin (U.S. Pat. No. 4,796,370) discloses a multi-element display wherein each element may be reversibly rotated about a mounting rod by an electric motor.

Nidelkoff (U.S. Pat. No. 4,164,824) illustrates one of the problems overcome in the present invention. A self-storing display allows each shutter to be received in a linear pocket so that it may be manually slid to a retracted position where the back plate is revealed. When the shutter is retracted, there must be sufficient space behind the background face to accomodate it.

Skrobisch (U.S. Pat. No. 3,273,270) discloses a segmented display wherein each segment is longitudinally divided and pivots to fold together to conceal its face. A linear actuator is shown in FIGS. 20 and 21 having a pinion gear that meshes with a rack.

Murray (U.S. Pat. No. 4,777,747) provides each segment of a seven segment display with a guide rim or flange overlapping edge to slidably receive an element that may be manually inserted or removed.

Weiss (U.S. Pat. No. 4,627,182) provides a two sided display element that may be rotated by the force of voltage applied to a crystal.

Halliday (U.S. Pat. No. 4,539,768) shows a seven segment display with a flap for each segment that may be manually pivoted to cover or uncover with assistance of spring-loaded pivots.

Chang (U.S. Pat. No. 4,796,370) shows a seven segment display wherein each segment has a transverse axle that may be rotated by a small electric motor.

Glattli (U.S. Pat. No. 3,764,200) discloses a cylindrical reflecting surface with an axially extending slot that has a flat planar element movable up or down to make the surface appear illuminated.

Steele (U.S. Pat. No. 3,814,506) provides panels having a pair of outer sheets with a third, center sheet slidably sandwiched therebetween. The center sheet is movable by a cam and lever mechanism.

Bugg (U.S. Pat. No. 3,789,525) discloses a pair of resilient film loops wherein one end of each loop is fixed in contiguous relation to a movable frame so that the film loops may be brought into and out of a visible position.

Trame (U.S. Pat. No. 4,220,948) provides a sliding shutter between front and back plates with a tab extending through an opening to manually slide the shutter.

Accordingly, it is an object and purpose of the present invention to provide a numeral display device which is compact in design and wherein its individual segments are self-storing and easily changeable.

SUMMARY OF THE INVENTION

The numeral display device includes a background face from which the numerals contrast. Each numeral comprises seven discreet segments which are arranged to form all of the numerals from 0 through 9.

Each segment includes a transparent outer pane and an inner pane which is parallel to and spaced from the outer pane. A spacer or spacers keep the inner pane in spaced relation to the outer pane in order to form a continuous pocket. A first portion of the pocket is aligned with the background face and is visible from the exterior of the display device. A second portion of the pocket is in angular relation to the first portion and is not visible but interior to the device.

A thin flexible film is allowed to travel the pocket provided between the panes. When the film fills the first portion, the segment will match the color of the surrounding background face of the display. Conversely, when the film is withdrawn from the first portion of the pocket the inner pane will be visible and the segment will contrast with the background.

In one embodiment, a slot is provided in the outer pane on the second portion so that the film is accessible. Affixed to the film where the slot provides an opening is a flat rack having protruding teeth. A motor having an extending rotating shaft terminates in a pinion gear which meshs with the teeth on the rack. Rotation of the pinion gear by the motor moves the rack linearly and, in turn, moves the film.

In another embodiment, the extending shaft of the motor terminates in a pulley which rotates rollers in contact with the film to move the film into or out of the first portion.

In another embodiment, a metal strip is affixed to the film. A magnet manipulated by an operator exterior to the display device moves the metal strip and the accompanying film into or out of the first portion.

BRIEF DESCRIPTION OF THE DRAWINGS

FIG. 1 is a sectional view taken along section line 10—10 of FIG. 9; and

DETAILED DESCRIPTION OF THE PREFERRED EMBODIMENTS

Figure 1:
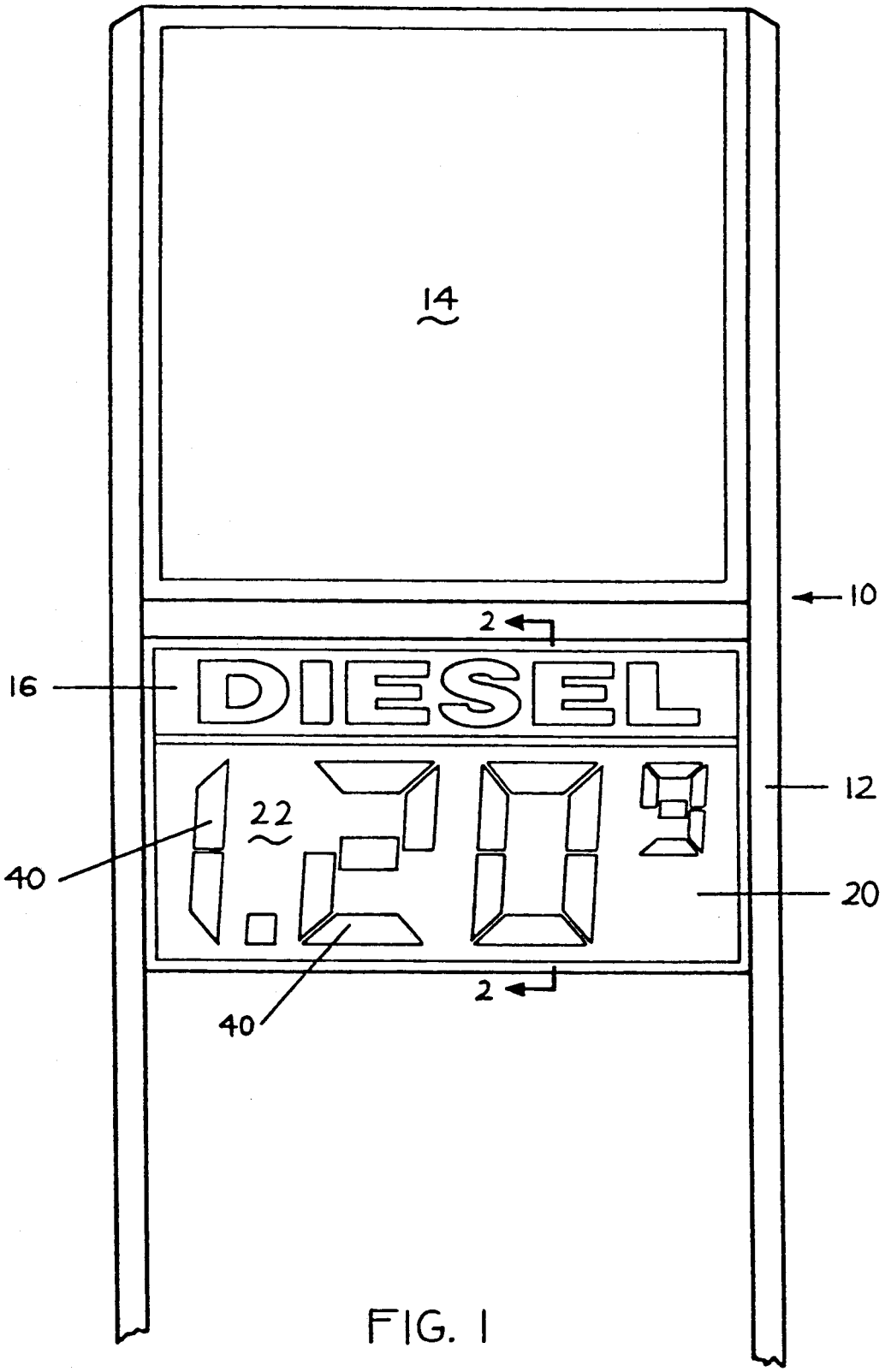
FIG. 1 is a perspective view of a first embodiment of a numeral display device constructed in accordance with the present invention.

Referring to the drawings in detail, FIG. 1 shows a highway sign structure 10 utilizing the invention. The sign structure 10 would be adjacent a street or highway in order to be visible to passing motorists. In addition to the visible display seen in FIG. 1, the structure 10 may include an additional identical display (not shown in FIG. 1) on the reverse side so that a display would be visible to motorists from both sides of the highway.

The sign structure 10 includes a frame 12. The structure 10 may also include a brand or vendor identification display 14 as well as a product identification display 16. In the present embodiment, the numeral display device 20 displays the price of motor fuel. It may be necessary to change the posted price of the fuel several times per day. At the same time, the size of the structure is such that the numeral display device may not be easily reached by personnel from the ground.

The numeral display device 20 includes a background face 22 from which the numerals displaying the price contrast. The background face may be constructed of aluminum, plastic, or other thin, lightweight material. The display may also be back-lighted from the interior of the frame 12. Each numeral comprises seven discreet segments. The individual segments may be lightened, darkened or changed in color from the surrounding background color. The segments are arranged to form all of the arabic numerals from 0 through 9. For example, each of the seven segments will be visible in order to form the numeral 8.

It should also be appreciated that the present invention can be easily adapted to display letters or other elements.

Figure 2:
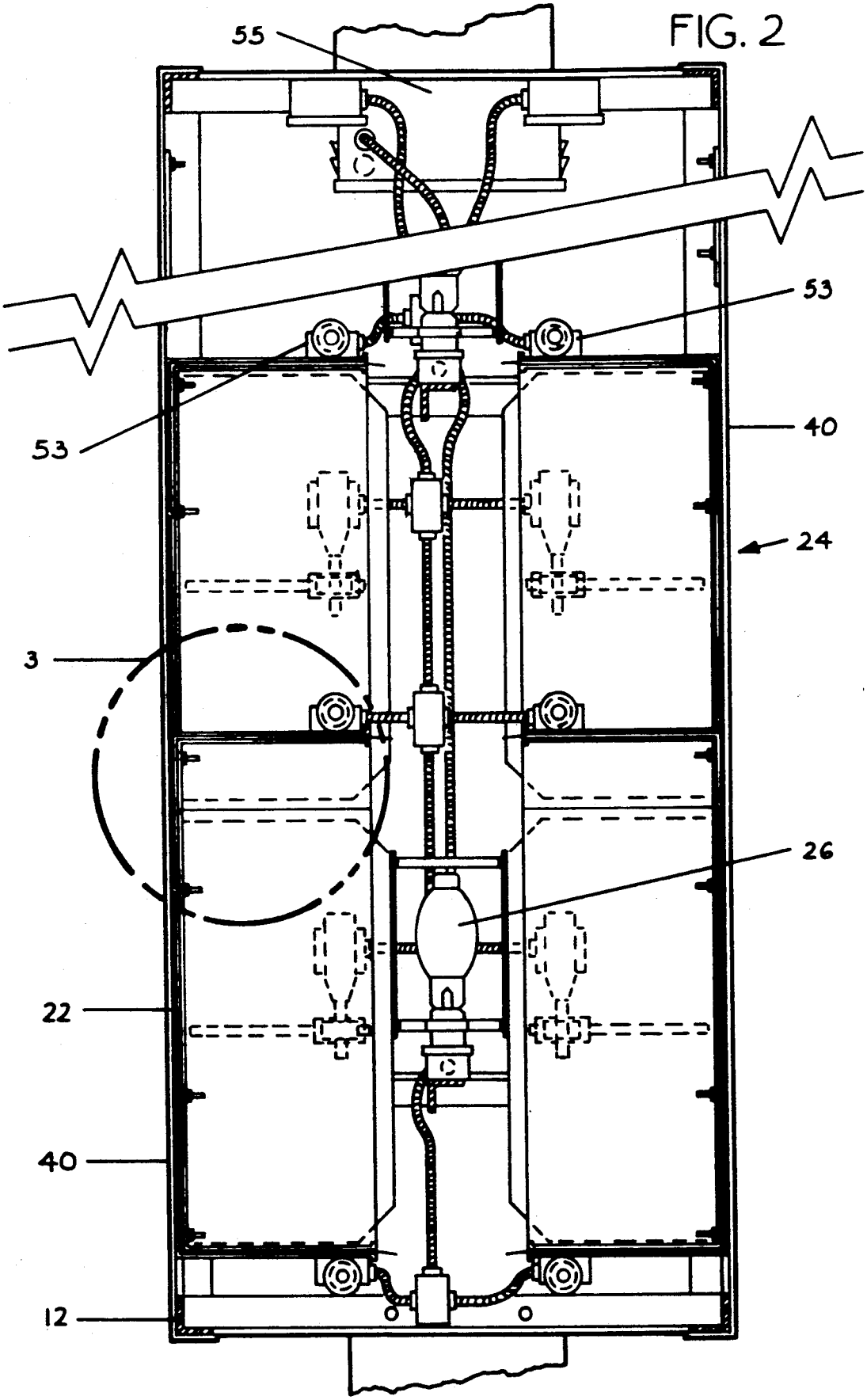
FIG. 2 is a sectional view taken along section line 2—2 of FIG. 1.

One embodiment 24 of the present invention is shown in FIGS. 1, 2, 3 and 4. FIG. 2 is a sectional view taken along section line 2—2 of FIG. 1. Internal illumination from a light source 26 makes the display device easily visible at night.

Figure 3:
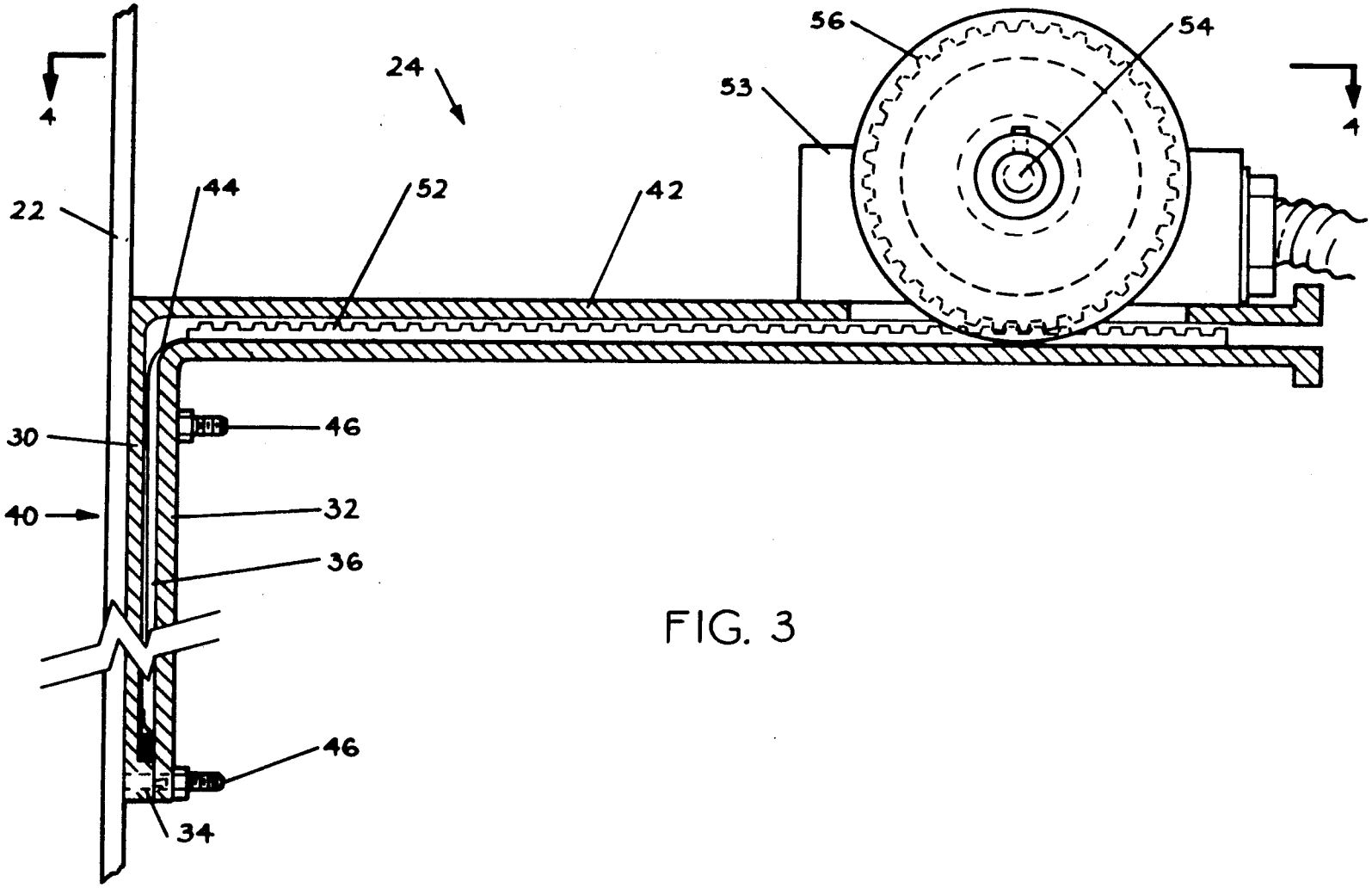
FIG. 3 is an enlarged view taken from the dashed circular line shown in 2.

FIG. 3 shows an enlarged view of one segment. It will be appreciated that each segment operates in a similar fashion and the description of one segment herein applies to the other segments. Each segment includes a transparent outer pane 30. An inner pane 32 is parallel to and spaced from the outer pane. In the present embodiment, a color will be chosen for the inner pane which contrasts with the background face 22. The inner pane and outer pane may be constructed of a rigid plastic material such as Lexan. A spacer or spacers 34 keep the inner pane in spaced relation to the outer pane in order to form a continuous pocket 36.

A first portion 40 of the panes 30 and 32 and the resulting continuous pocket 36 are aligned with an opening in the background face 22. This first portion 40 is visible from the exterior and constitutes one of the segments visible in the display.

A second portion 42 of the panes 30 and 32 and the resulting continuous pocket 36 is in an angular relation to the first portion 40. In the present embodiment, the second portion 42 is at a 90 degree angle to the first portion 40. The second portion is not visible from the exterior of the display and is interior to the frame 12. As will be appreciated from the description herein, the angular relationship of the first portion to the second portion allows each segment to take up reduced space along the background face 22.

A film of mylar or other thin, flexible material 44 is allowed to travel within the continuous pocket provided between the panes. The film 44 will be opaque and of the same color as the background face 22. When the film 44 fills the first portion 40, the segment will match the color of the surrounding background face of the display. Conversely, when the film is slidably withdrawn from the first portion of the pocket, the inner pane 32 will be visible. The segment will then contrast with the background and will be visible from the exterior. Alternatively, the device could be constructed so that the film could be of a contrasting color to the background and the inner pane could be of the same color.

Each segment may be secured to the background face 22 through fasteners 46. Thus secured, the background face provides a barrier to water or dirt entering the interior of the device 20.

Figure 4:
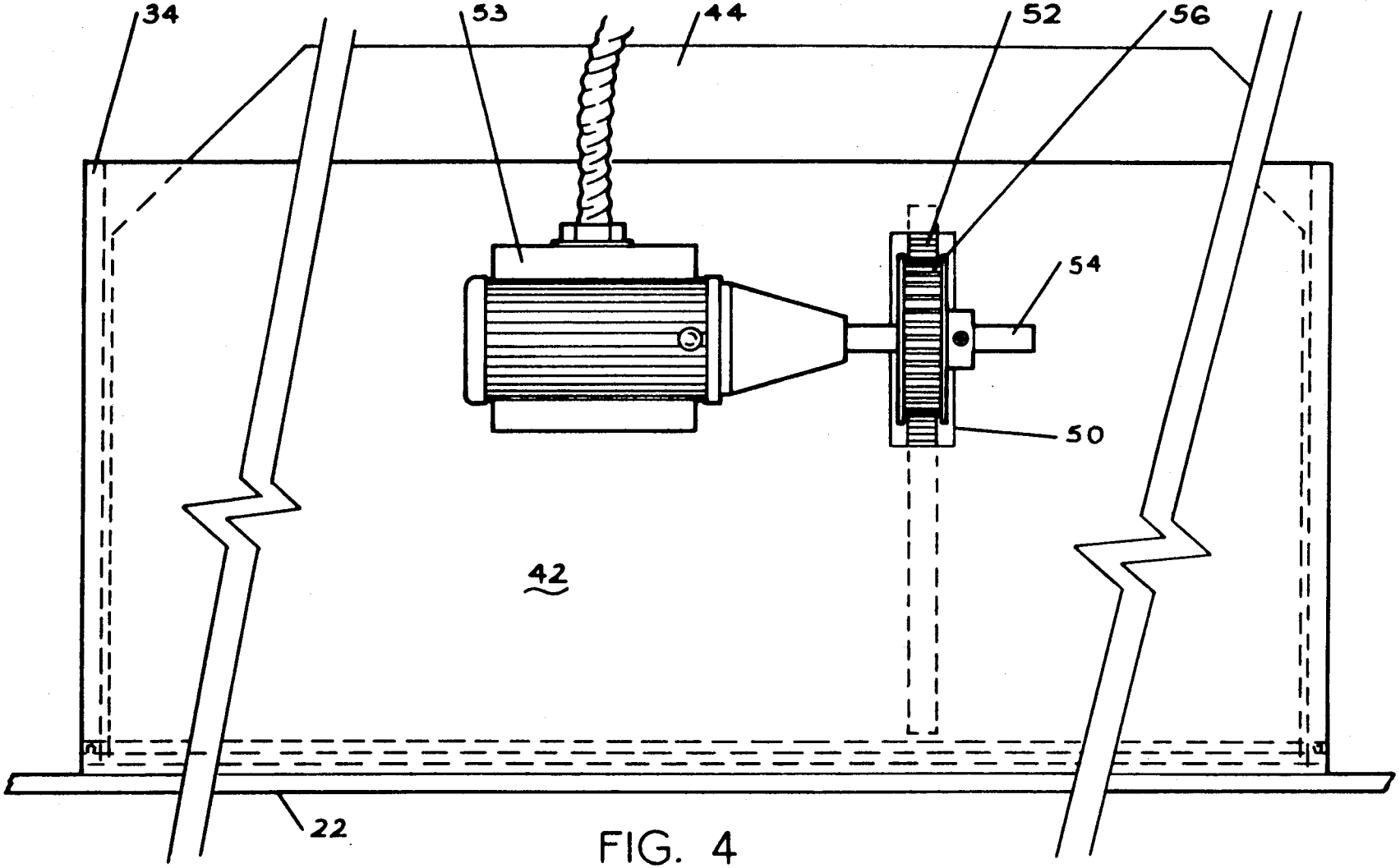
FIG. 4 is a sectional view taken along section line 4—4 of FIG. 3.
Figure 5:
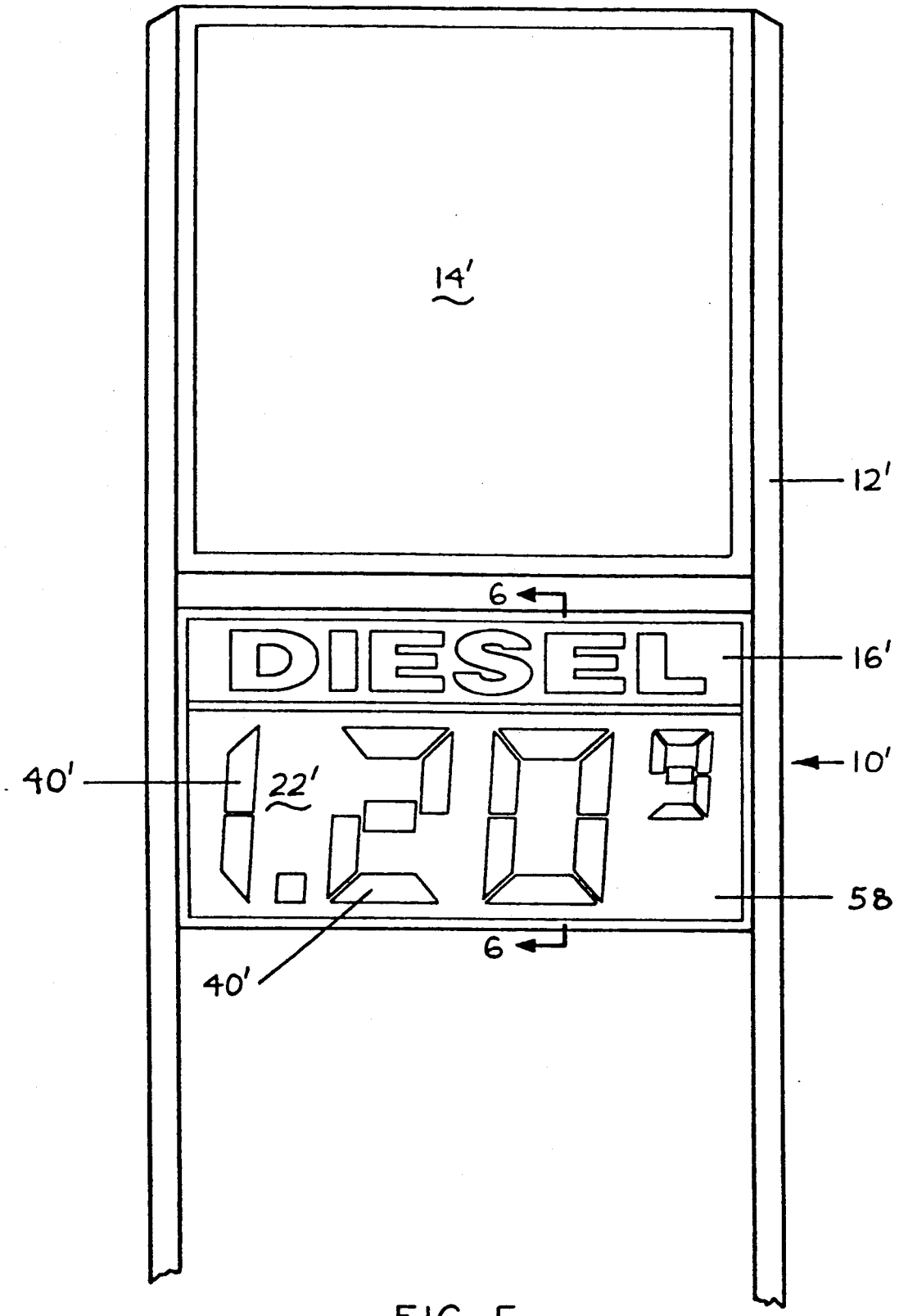
FIG. 5 is a perspective view of a second embodiment of a numeral display device constructed in accordance with the present invention.
Figure 6:
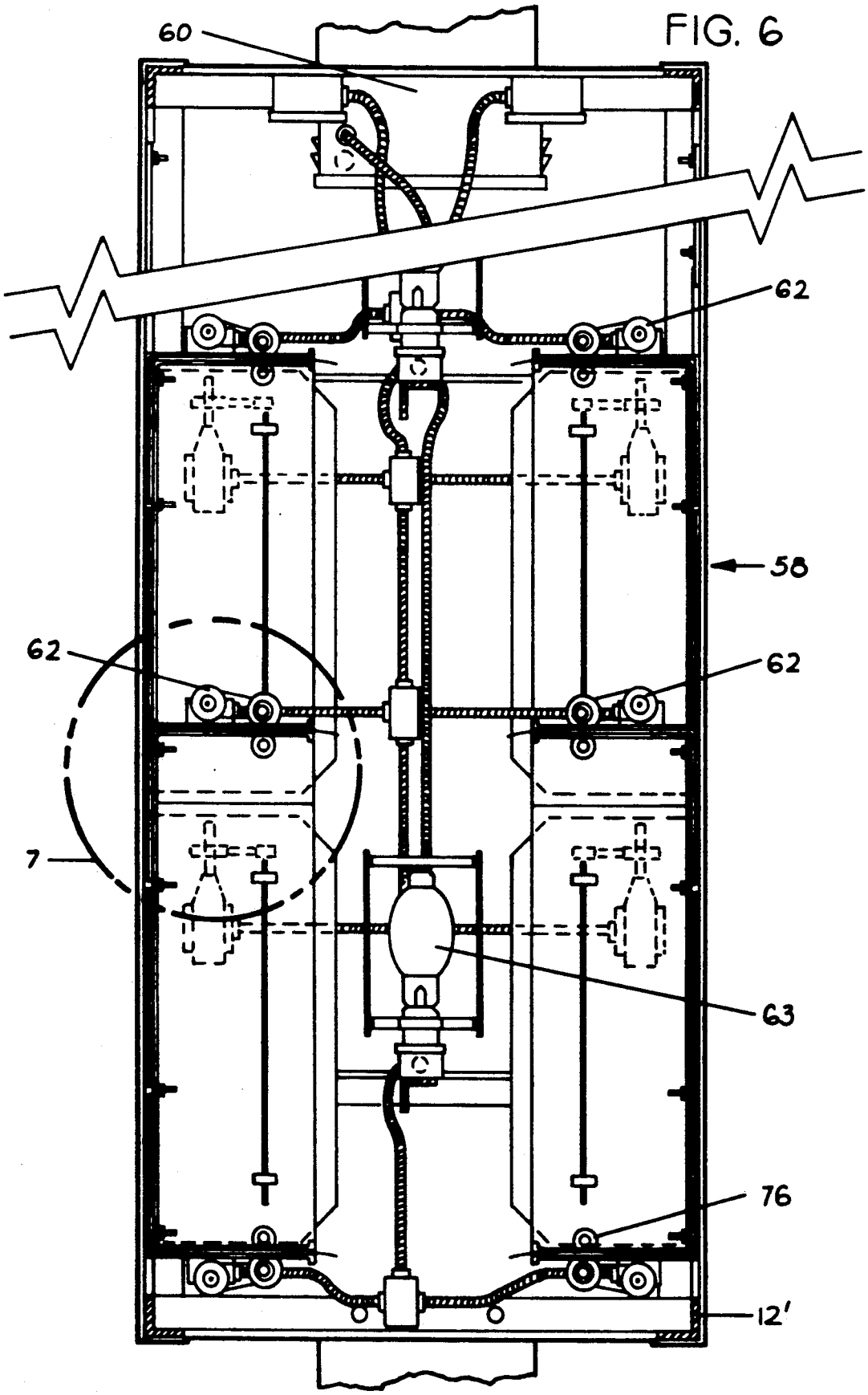
FIG. 6 is a sectional view taken along section line 6—6 of FIG. 5.

FIG. 4 is a sectional view taken along section lines 4—4 of FIG. 3. A slot 50 is provided in the outer pane 30 along the second portion 42 so that the film 44 is accessible. Affixed to the film where the slot provides an opening is a flat rack 52 having protruding teeth With reference to FIGS. 2, 3, and 4, an electric motor 53 has an extending rotating shaft 54. The small, lightweight motor may be mounted on the second portion 42. A low voltage direct current motor may be powered by household alternating electric current passed through a transformer 55. The rotating shaft terminates in a pinion gear 56 which meshs with the teeth on the rack 52. Accordingly, rotation of the pinion gear 56 by the motor moves the rack 52 linearly. Movement of the rack 52, in turn, slidably moves the film 44 within the continuous pocket.

When the gear 56, moves in the direction indicated by arrow 58, the film 44 will move into the first portion 40. Conversely, when the gear moves in the direction indicated by arrow 60, the film will move out the first portion 40.

The film 44 will be flexible enough to easily negotiate the angle between the first portion and the second portion as it travels.

FIG. 4 is a sectional view taken along section lines 4—4 of FIG. 2. The spacers 34, positioned along the edges of the panes, are opaque so as not to allow leakage of light from the light source 26 interior to the display to the exterior.

The motor 53 will be connected to a control mechanism (not shown) which will control power to the motor and control its direction. The control mechanism will control each motor corresponding to the seven segments that comprise a numeral.

Switches (not shown) for the control mechanism may be remotely located so that the numerals may be quickly and conveniently changed as desired.

Figure 7:
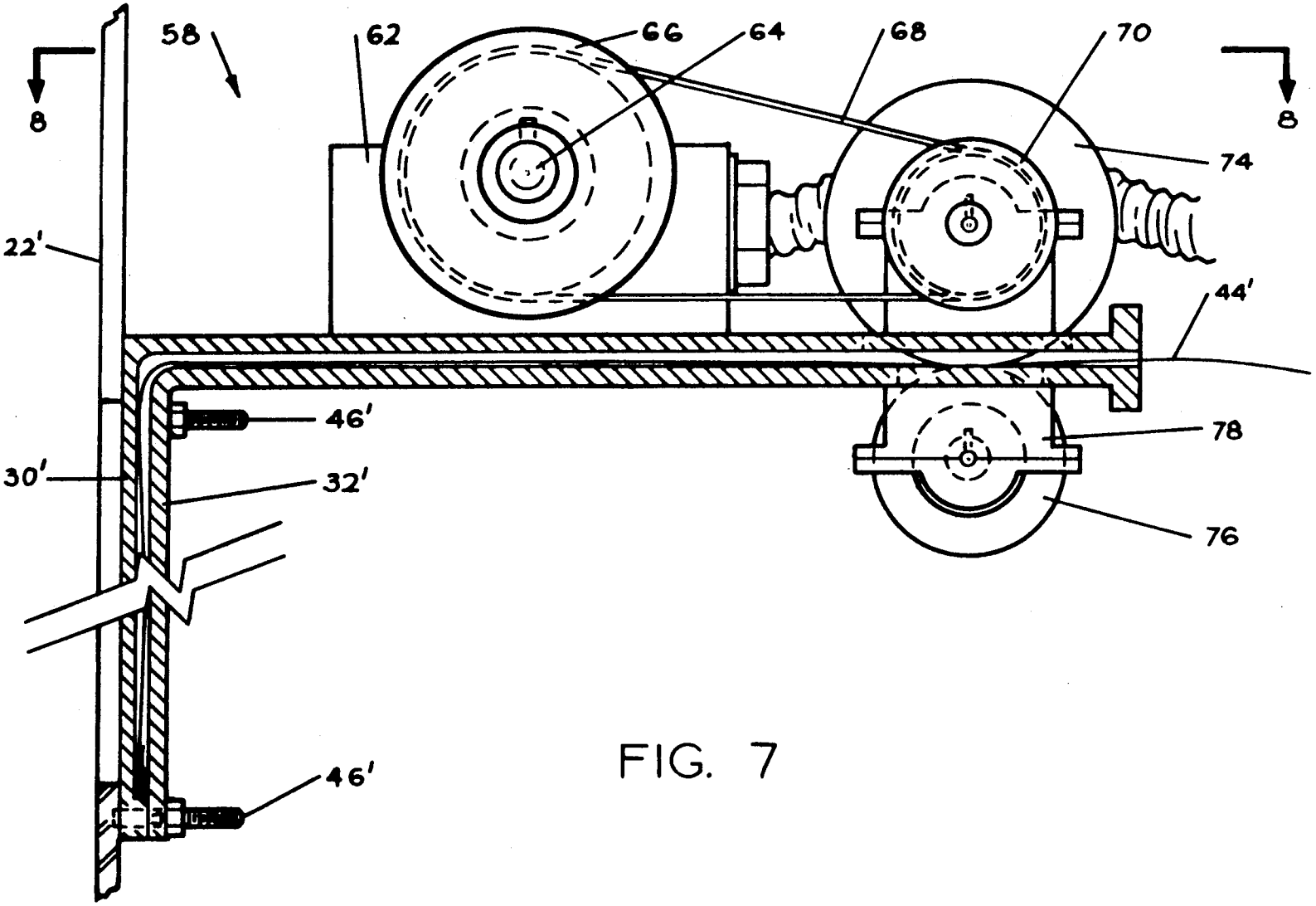
FIG. 7 is an enlarged view showing the portion within the circular dashed line in FIG. 6.
Figure 8:
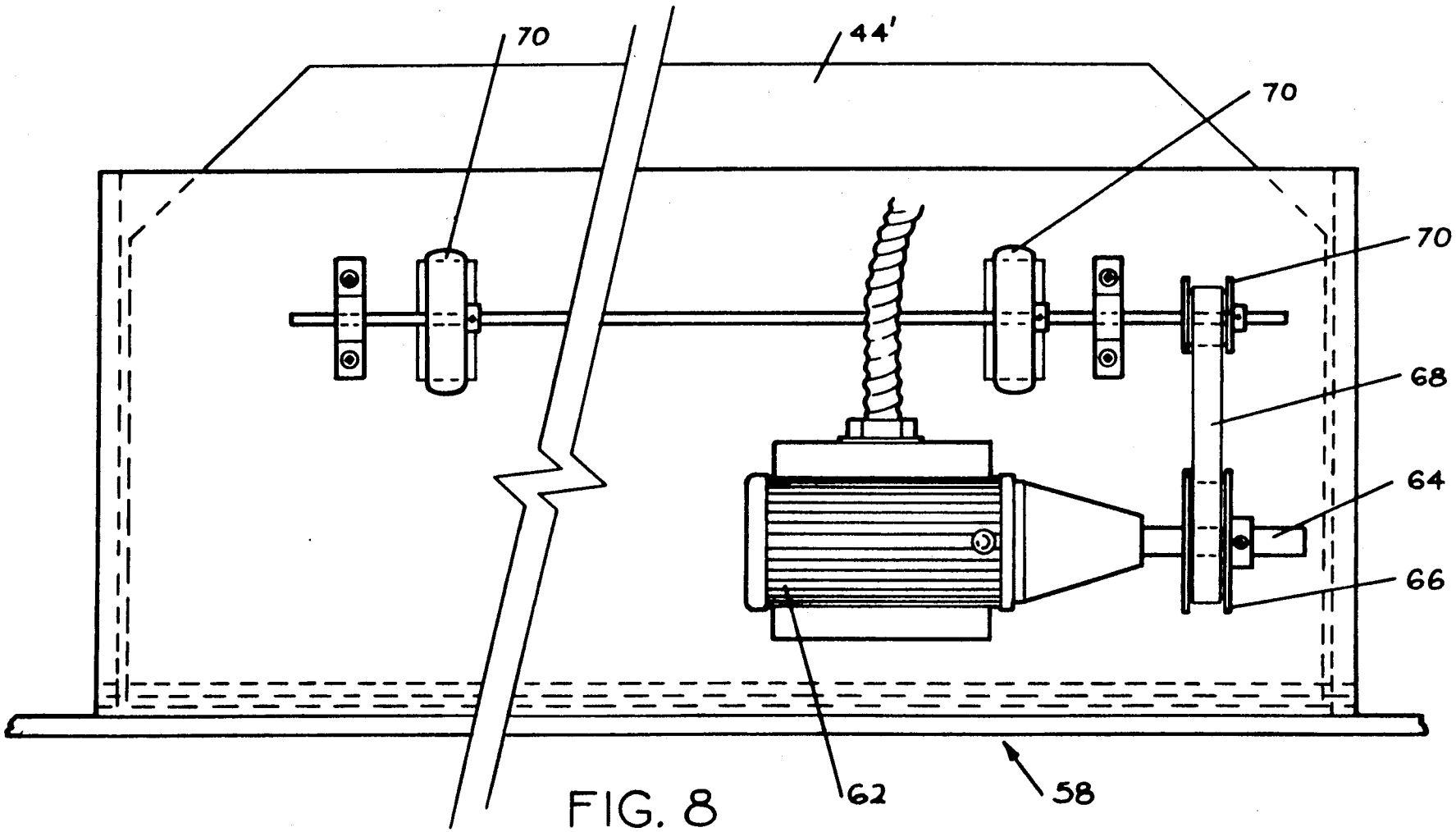
FIG. 8 is a sectional view taken along section line 8—8 of FIG. 7.

Another embodiment 58 is shown in FIGS. 5, 6, 7 and 8. The frame 12' and background face 22' would be similiar to the previously described embodiment. A sectional view, taken along section lines 6—6 of FIG. 5, can be seen in FIG. 6. Relays and transformers 60 bring low voltage power to each electric motor 62. Internal illumination from a light source 63 makes the display easily visible at night. With particular reference to FIGS. 7 and 8, the rotating shaft 64 of the motor 62 terminates in a first pulley 66 which moves a continuous belt 68. Movement of the belt rotates a second pulley 70 which rotates a pair of drive wheels 74 that rest snugly against the film 44'. Opposite the drive wheels 74 are free rotation wheels 76 which keep the film 44' snug against the drive wheels. The free rotation wheels are held in place by brackets 78.

Rotation of the drive wheels 74 by the motor 62 will cause the film 44' to slide within the continuous pocket 36'. As previously described, the film 44' will be flexible enough to negotiate the angle between the first portion and second portion.

Figure 9:
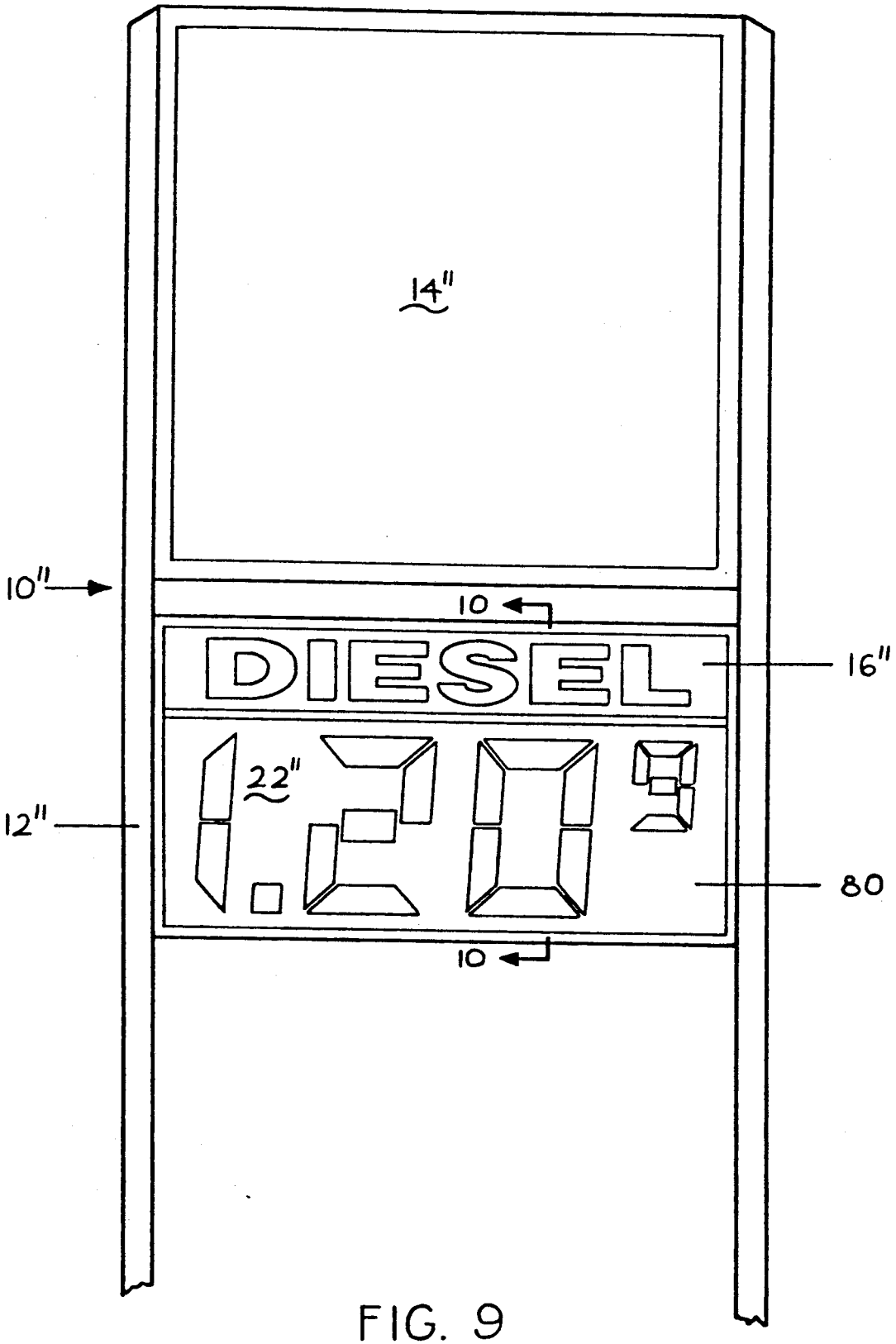
FIG. 9 is a perspective view of a third embodiment of a numeral display device constructed in accordance with the present invention.
Figure 10:
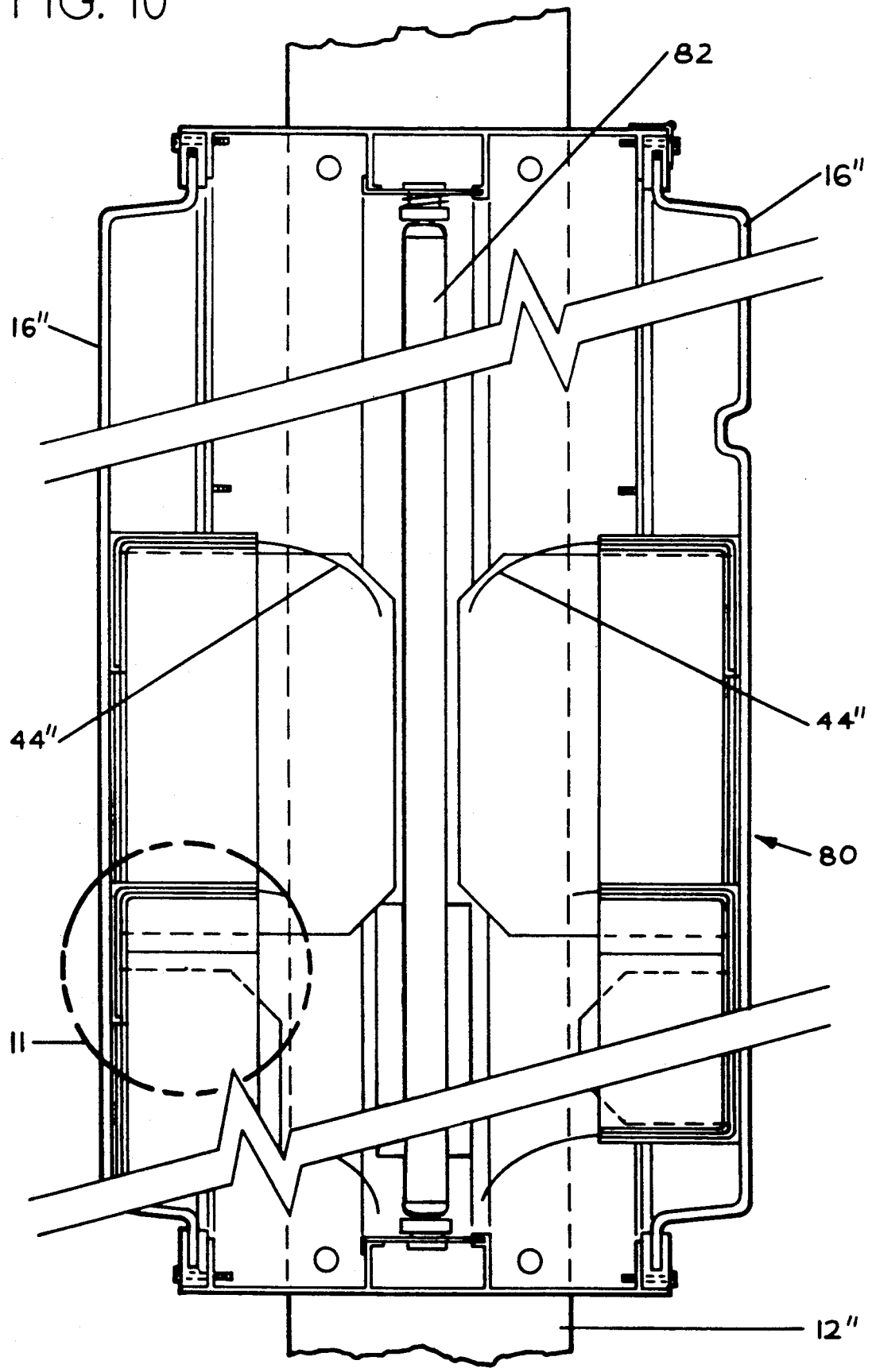
Figure 11:
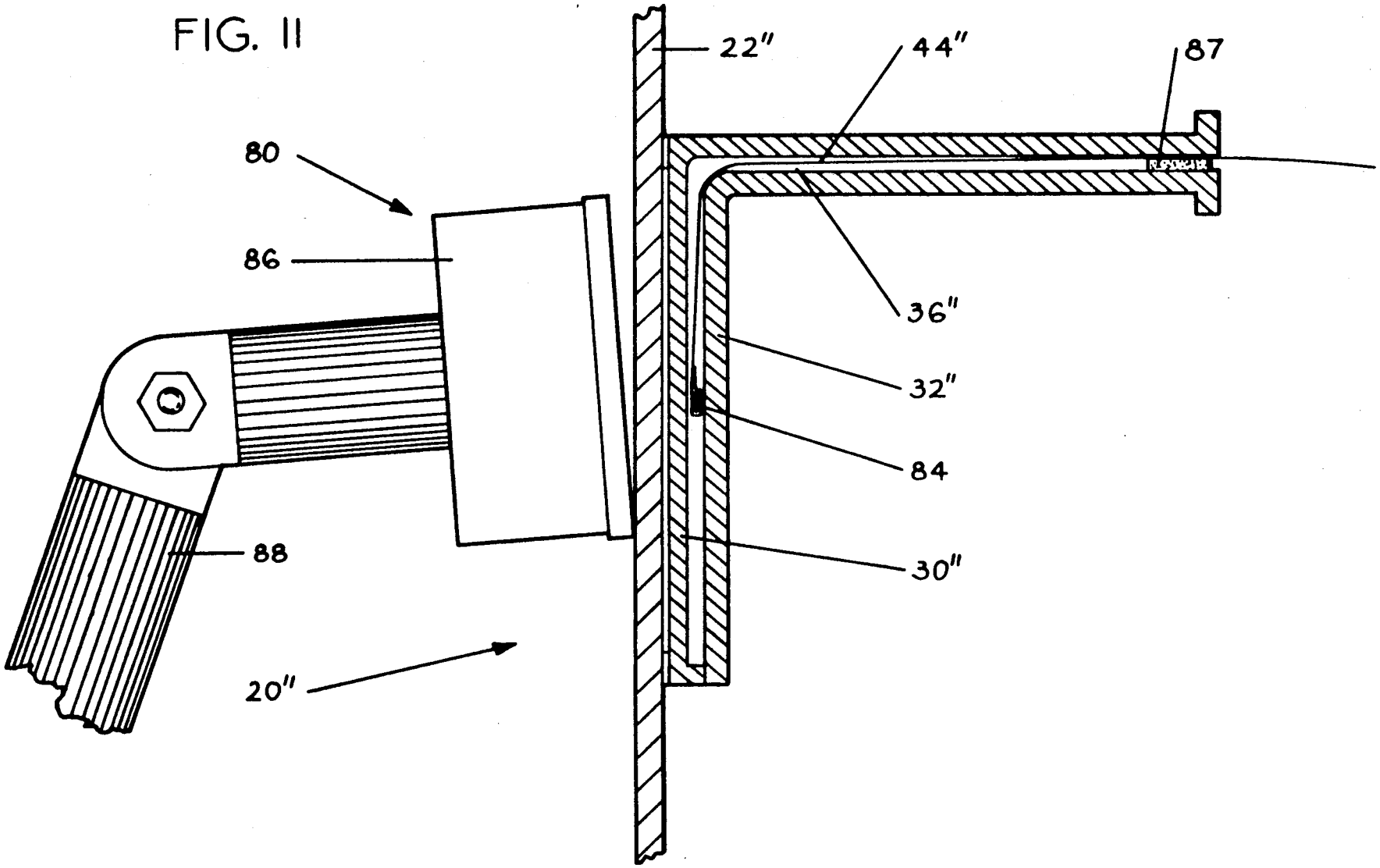
FIG. 11 an enlarged view of a portion indicated by the circular dashed line in FIG. 10.

A further embodiment 80 is shown in FIGS. 9, 10, and 11. The frame 12" and background face 22" from which the numerals contrast would be similiar to the previous embodiments. As seen in the sectional view of FIG. 10, there are no motors or mechanized means to move the films 44". Internal illumination from a light source 82 makes the display easily visible at night.

As best seen in FIG. 11, a thin metal strip 84 is affixed to each film 44" at its front edge. When a magnet 86, exterior to the display 20", is moved near the background face 22", the metal strip 84 and its accompanying film 44", will be caused to move within the continuous pocket 36". Since the outer pane 30" is composed of a plastic material, the magnetic field passes easily therethrough. A pad 87 within the continuous pocket 36" retains the film 44" in place until moved by the magnet.

The magnet 86 may be attached to a pole 88, so that an operator (not shown) can easily change the segments of the display.

Whereas, the present invention has been described in particular relation to the drawings attached hereto, it should be understood that other and further modifications, apart from those shown or suggested herein may be made within the spirit and scope of this invention.

What is claimed is:

1. A numeral display device having at least one visible face which comprises:

a. a plurality of segments, each segment having a transparent outer pane and a spaced, parallel inner pane, said outer pane and said inner pane forming a pocket, a first portion of said pocket being aligned with and visible in said face and a second portion of said pocket in angular relation to said first portion;

b. a plurality of flexible films, one said film received in each said pocket; and c. means to slidably insert and withdraw each said film from each said first portion of each said pocket, each said pocket adapted to guide each said film as it travels therethrough, so that each said segment will either contrast with or match said face.

2. A numeral display device as set forth in claim 1 wherein said first portion of said pocket is substantially perpendicular to said second portion.

3. A numeral display device as set forth in claim 1 wherein said segments are arranged in elements of seven segments in order to selectively form arabic numerals.

4. A numeral display device as set forth in claim 1 wherein said inner panes contrast with said face and said films match said face.

5. A numeral display device as set forth in claim 1 wherein each said flexible film has a front edge to which is affixed a metal strip so that movement of a magnet exterior to said face will cause said film to be slidably inserted or withdrawn from said first portion of said pocket.

6. A numeral display device in claim 1 wherein said means to slidably insert and withdraw includes a plurality of motor means.

7. A numeral display device as set forth in claim 6 wherein each said motor means has a rotating shaft that terminates in a pinion gear and wherein a rack affixed to each said film engages with said pinion gear in order to translate rotation of each said shaft to movement of said film to slidably insert and withdraw each said film.

8. A numeral display device as set forth in claim 6 wherein each said motor means has a rotating shaft that terminates in a roller which engages with one of said films in order to translate rotation of each said shaft to movement of said film to slidably insert and withdraw each said film.

9. A numeral display device having at least one visible face which comprises:

a. a plurality of segments, each segment having a transparent outer pane and a spaced, parallel inner pane, said outer pane and said inner pane forming a pocket, a first portion of said pocket being aligned with and visible in said face and a second portion of said pocket which is not visible in said face;

b. a plurality of flexible films, one said film received in each said pocket; and c. means to slidably insert and withdraw each said film from each said first portion of each said pocket, each said pocket adapted to guide each said film as it travels therethrough, so that each said segment will either contrast with or match said face.

* * * * *